United States Patent [19]

Hagen

[11] Patent Number: 4,636,768

[45] Date of Patent: Jan. 13, 1987

[54] COMPRESSION CONNECTION FOR POTENTIOMETER LEADS

[75] Inventor: Donald R. Hagen, Brooklyn Center, Minn.

[73] Assignee: Resistance Technology, Inc., Minneapolis, Minn.

[21] Appl. No.: 784,331

[22] Filed: Oct. 4, 1985

[51] Int. Cl.[4] ..... H01C 1/012

[52] U.S. Cl. ..... 338/312; 338/332; 338/174

[58] Field of Search ..... 338/312, 332, 273, 276, 338/174

[56] References Cited

U.S. PATENT DOCUMENTS

| | | | |
|---|---|---|---|
| 3,248,474 | 4/1966 | Weed | 174/68.5 |
| 3,334,395 | 8/1967 | Cook et al. | 29/625 |
| 3,345,741 | 10/1967 | Reimann | 29/626 |
| 3,391,455 | 7/1968 | Hirohata et al. | 29/625 |
| 3,659,245 | 4/1972 | Payne | 338/312 |
| 4,110,904 | 9/1978 | Johnson | 29/628 |

*Primary Examiner*—Harold Broome
*Assistant Examiner*—M. M. Lateef
*Attorney, Agent, or Firm*—Kinney & Lange

[57] ABSTRACT

A miniature variable resistor assembly, preferably for use in a hearing aid, includes an insulating base having a terminal element molded within the base. One end portion of the terminal element extends outwardly from the insulating base and another portion of the terminal element is configured in a loop extending from the base. The loop has two spaced-apart portions. A plate of insulating material includes a resistance element and an aperture adjacent the resistance element with the loop extending through the aperture and each spaced-apart portion being distorted against the wall of the aperture and into conductive engagement with the resistance element.

4 Claims, 4 Drawing Figures

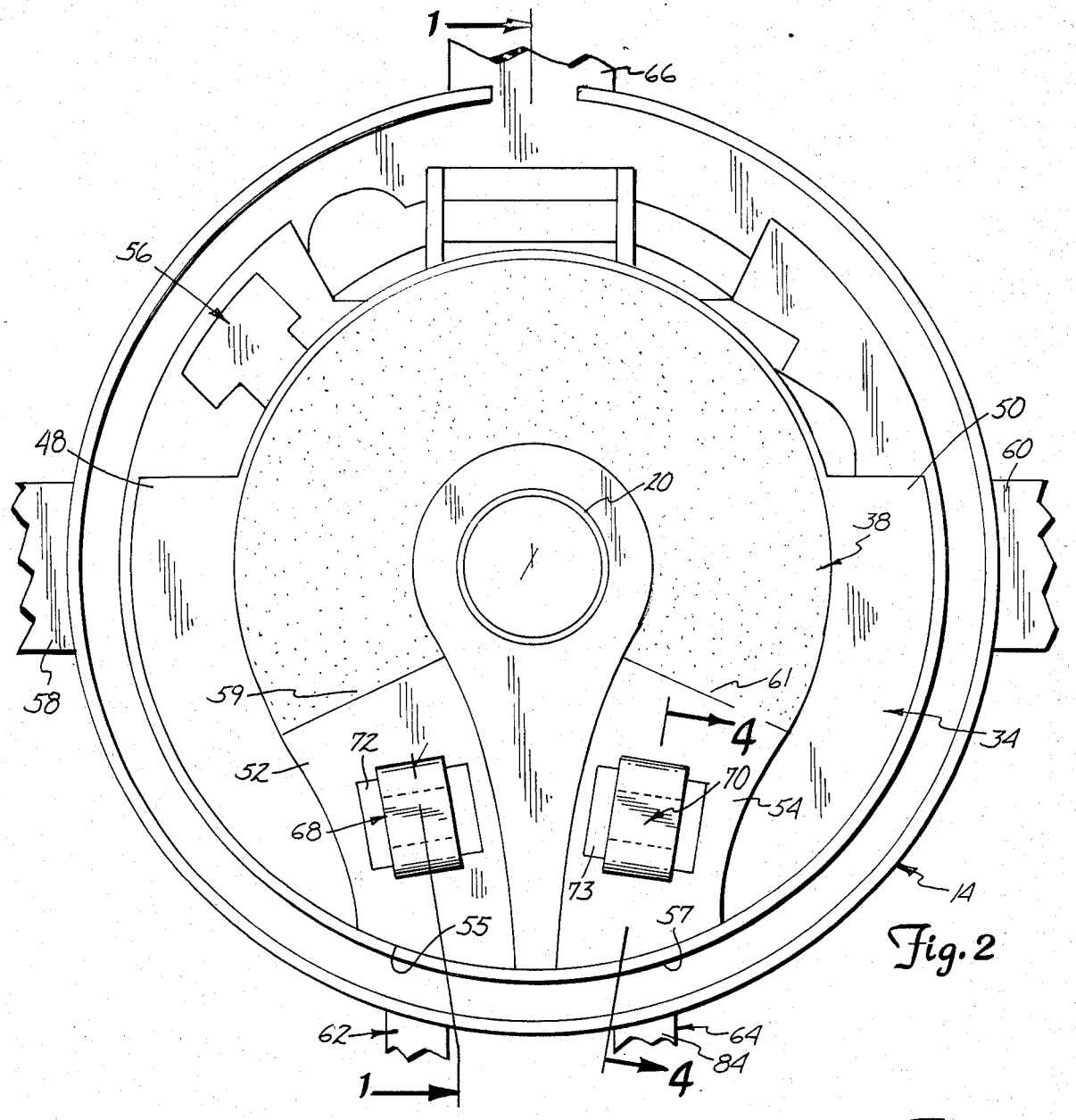
Fig. 2
Fig. 3
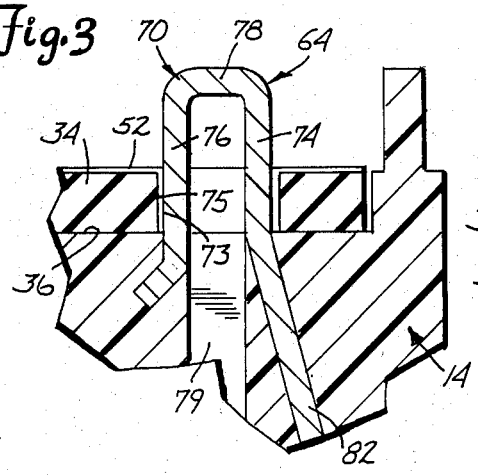
Fig. 4
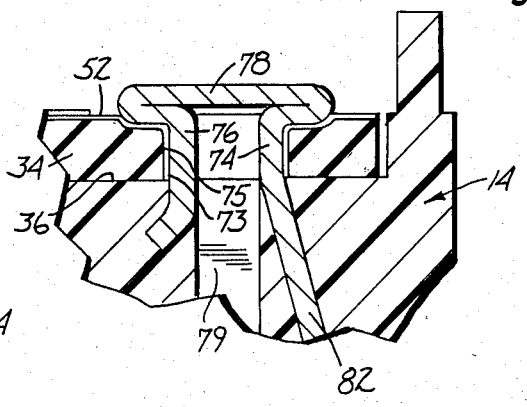

COMPRESSION CONNECTION FOR POTENTIOMETER LEADS

REFERENCE TO CO-PENDING APPLICATION

Reference is hereby made to a co-pending patent application entitled "Trimmer Control Mounted in Potentiometer Knob," filed on even date herewith under Ser. No. 784,332 and assigned to the same assignee as the present application.

BACKGROUND OF THE INVENTION

1. Field of the Invention

The present invention relates to variable resistors, and in particular, it relates to miniature variable resistors of the kind used in hearing aids.

2. Description of the Prior Art

A great effort has been made to reduce the size of hearing aids. One major component of a hearing aid is a potentiometer which is used as a volume control. The potentiometer generally includes a housing, a resistance element, terminals, a sliding contact and a knob member. All of these elements when put together must make as small a potentiometer as possible to help minimize the overall size of the hearing aid.

One problem in the assembly of a miniature potentiometer includes positioning and securing the resistance element within the housing and conductively connecting the resistance element to the terminals of the potentiometer. Conventional methods for attaching a resistance element to a terminal are not necessarily suitable, practical or economical for assembling a miniature potentiometer. Some methods of connecting electronic components and circuit boards are described in the following patents:

| Inventors | Patent No. |
|---|---|
| Payne | 3,659,245 |
| Reimann | 3,345,741 |
| Johnson | 4,110,904 |
| Hirohata et al | 3,391,455 |
| Weed | 3,248,474 |
| Cook et al | 3,334,395 |

SUMMARY OF THE INVENTION

The present invention includes a variable resistor assembly, preferably for use in a hearing aid, having an insulating base and a plate of insulating material disposed on the base. The plate includes a resistance element and an aperture extending through the plate adjacent the resistance element. The resistor assembly further includes a sliding contact in conductive engagement with the resistance element and means for moving the sliding contact with respect to the resistance element. A terminal element is molded within the base and has a first end portion extending outwardly from the insulating base for connection to another circuit element and a second looped portion extending outwardly from the base proximate the plate through the aperture in the plate. The second looped portion includes two spaced-apart portions extending through the aperture and being distorted outwardly against the wall of the aperture and into conductive engagement with the resistance element.

BRIEF DESCRIPTION OF THE DRAWINGS

FIG. 2 is a plan view of the housing of the potentiometer with a plate containing a resistance element disposed thereon.

FIG. 3 is an enlarged sectional view illustrating one terminal element extending through the plate holding the resistance element before compression.

FIG. 4 is an enlarged sectional view illustrating the terminal element of FIG. 3 after compression taken along the line 4—4 in FIG. 2.

DETAILED DESCRIPTION OF THE PREFERRED EMBODIMENTS

Figure 1:
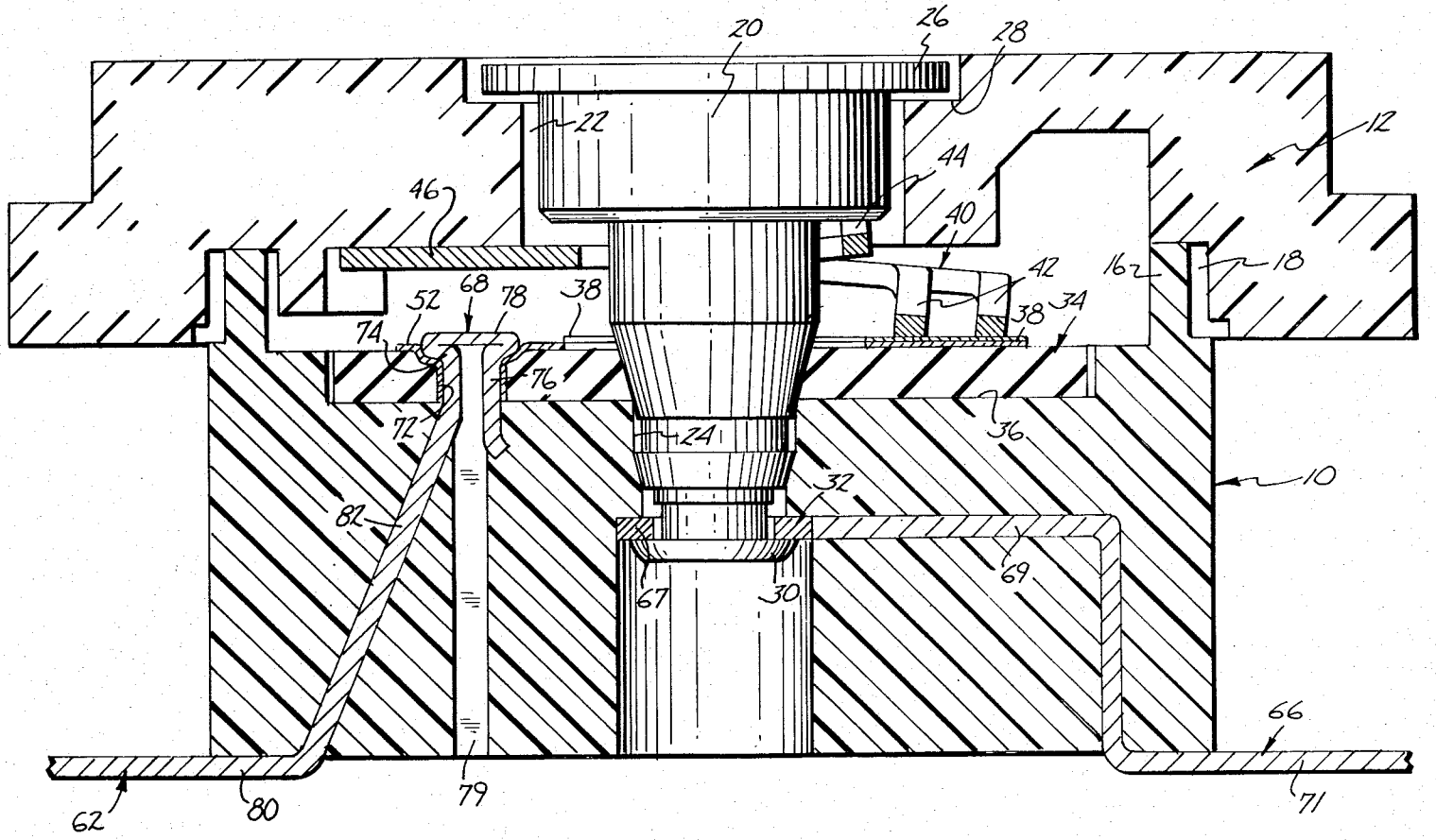
FIG. 1 is a cross sectional view of a potentiometer of the present invention.

A potentiometer of the present invention is generally indicated at 10 in FIG. 1. The potentiometer 10 includes a rotatable knob member 12, rotatably attached to a housing 14. The housing 14 is made of a nonconductive plastic, such as a glass-filled nylon. The housing 14 includes an annular lip 16 which engages an annular slot 18 of the knob member 12 and whose engagement constitutes a sliding interface between the knob member 12 and the housing 14.

A spindle 20 rotatably secures the knob member 12 to the housing 14. The spindle 20 extends through a bore 22 in the knob member 12 and a bore 24 in the housing 14. An annular flange portion 26 of the spindle 20 acts against a shoulder 28 of the knob member 12 in cooperation with a swaged end 30 acting against a shoulder 32 of the housing to hold the knob member 12 and the housing 14 together. The spindle 20 is made of metal and used as a conductor.

A plate member 34 is positioned on an inner surface 36 of the housing 14. The plate 34 includes a resistance element 38. A conductive sliding element 40 contacts the resistance element 38 at a first end 42 and contacts the spindle 20 at a second end 44 and is fixedly attached to the knob 12 at a third end 46. The element 40 conductively connects the resistance element 38 to the spindle 20 in a well known manner.

In FIG. 2, the resistance element 38 is shown in plan view along with the plate 34. The plate 34 is preferably made of a nonconductive plastic material and includes outer wing sections 48 and 50 which help position the plate within the housing 14. The plate further includes left and right conductive sections 52 and 54 preferably made of a conductive silver coating. The sections 52 and 54 act as terminals for the resistance element 38. The resistance element 38 is coated onto the plate 34 in an arc of greater than 180° but less than a complete circle. The sections 52 and 54 extend from edges 55 and 57 of the plate, respectively, to end portions 59 and 61.

The potentiometer of the present invention also includes an on/off switch, generally indicated at 56, which is well known in the art. The on/off switch 56 includes terminals 58 and 60. The switch 56 is connected to a power circuit for turning the power on and off to a device with which the potentiometer of the present invention is used, such as a hearing aid.

The sections 52 and 54 conductively connect the resistance element to potentiometer terminals 62 and 64. Terminal 66 is conductively connected to the spindle 20, as best illustrated in FIG. 1. The terminals 62, 64 and 66 are connected to other circuit elements (not shown). The terminal 66 has an inner portion 67, an intermediate portion 69 and an outer portion 71. The housing 14 is molded with the inner portion 67 and the intermediate portion 69 in position.

The housing is also molded with the terminals 62 and 64 in position. The terminal 62 includes an end portion 80, an intermediate portion 82 and an end portion 68, as best illustrated in FIG. 1. The intermediate portion 82 is molded in place. The end portion 68 has a first leg portion 74, a second leg portion 76 and an intermediate portion 78 joining the portions 74 and 76. Both leg portions 74 and 76 are molded into the housing at lower sections.

The terminal 64 also has an end portion 84, an intermediate portion (not shown, but like the intermediate portion 82) and an upper end portion 70 of the same construction as the end portion 68 of the terminal 62. The end portions 68 and 70 extend through apertures 72 and 73, respectively, of the plate 34. The end portions 68 and 70 are used to both hold down the plate 34 to the surface 36 of the housing 10 and to conductively connect the resistance element to the terminals 62 and 64. The coating sections 52 and 54 extend along the walls of the apertures 72 and 73, as illustrated by reference character 75 in FIGS. 3 and 4. Extension of the coating along the apertures further ensures proper conductive contact between the terminals 62 and 64 and the resistance element.

The terminals 62 and 64, having been molded in place with sections 68 and 70 extending above the surface 36, provide an ideal mechanism for positioning the plate 34 during assembly of the potentiometer. The potentiometer of the present invention is miniature in size with the housing of the potentiometer being less than three-sixteenth's inches (3/16") in diameter and the resistance element having an arc whose radius is less than 3/32 of an inch. The attachment of such a miniature resistance element to a miniature housing of the potentiometer using conventional methods for a larger potentiometers is not suitable, practical or economically efficient. The upper end sections 68 and 70 of the present invention provide a method of positioning and securing the plate 34 using automated equipment.

Referring to FIG. 3 wherein only the upper end portion 70 of the terminal 64 is illustrated, the upper end portion 70 is shown in an uncompressed state. It should be understood that both upper end portions 68 and 70 are in an uncompressed state when the plate 34 is dropped onto the housing with the sections 68 and 70 extending through the apertures 72 and 73, respectively. In this manner, the plate is in a proper position within the housing. The intermediate section 78 is then struck, spreading apart the portions 74 and 76 against the walls of the aperture 74 and the section of coating 75. A bore 79 is provided in the housing with inner sections of portions 68 and 70 facing the bore to aid in spreading the portions 68 and 70. As will be appreciated, the spreading of the walls 74 and 76 has two effects. The first effect is to secure the plate 34 against the surface 36 of the housing 10. The second effect is to ensure conductive contact between the terminals and the silver coating 52 of the plate 34.

The knob member 12 is then attached to the housing 14 using spindle 20 in a manner well known to those skilled in the art.

In summary, the present invention provides an efficient and economic manner of securing a plate holding a resistance element to a potentiometer housing in a miniature potentiometer. With the terminals molded into the housing and each having a portion extending above the surface of the housing, the plate can be easily positioned on the housing and then secured thereto.

Although the present invention has been described with reference to preferred embodiments, workers skilled in the art will recognize that changes may be made in form and detail without departing from the spirit and scope of the invention.

What is claimed is:

1. A variable resistor assembly comprising:

a molded insulating base;

a plate of insulating material disposed on said base, the plate having a resistance element thereon and an aperture through the plate adjacent the resistance element;

a sliding contact in conductive engagement with the resistance element;

means for moving the sliding contact with respect to the resistance element; and a terminal element having first and second end portions and an intermediate portion integral with the end portions, the intermediate portion being molded into the molded base, the first end portion of the terminal element extending outwardly from the insulating base for connection to another circuit element, and the second end portion extending through the aperture in the plate and including two spaced-apart segments within the aperture and an intermediate segment, said end portion being compressed to distort the spaced-apart segments into conductive engagement with the resistance element and to force the two spaced-apart segments outwardly into engagement with the wall of the aperture.

2. The resistor assembly of claim 1 in which the aperture of the plate has a conductive coating so that the spaced-apart segments of the terminal element are forced into conductive engagement with the coating.

3. The resistor assembly of claim 1 in which there are two spaced apertures in the plate of insulating material adjacent different portions of the resistance element and in which there are two such terminal elements each with a second end portion, extending through one of the apertures, both second end portions being of similar configuration and both being compressed in a similar manner into conductive engagement with the resistance element.

4. The resistor assembly of claim 1 in which both spaced-apart segments are molded into the molded base.

* * * * *